US007881648B2

(12) United States Patent
Yoshida et al.

(10) Patent No.: US 7,881,648 B2
(45) Date of Patent: Feb. 1, 2011

(54) POSITIVE CHARGE CONTROL RESIN FOR ELECTROPHOTOGRAPHIC FUNCTIONAL COMPONENT PARTS, DEVELOPING ROLLER, AND ELECTROPHOTOGRAPHIC APPARATUS

(75) Inventors: Tatsurou Yoshida, Tsukuba (JP); Eri Yagi, Tsukuba (JP)

(73) Assignee: Canon Kasei Kabushiki Kaisha, Tsukuba-Shi (JP)

( * ) Notice: Subject to any disclaimer, the term of this patent is extended or adjusted under 35 U.S.C. 154(b) by 889 days.

(21) Appl. No.: 11/719,022

(22) PCT Filed: May 29, 2006

(86) PCT No.: PCT/JP2006/311147

§ 371 (c)(1),
(2), (4) Date: May 10, 2007

(87) PCT Pub. No.: WO2006/134788

PCT Pub. Date: Dec. 21, 2006

(65) Prior Publication Data

US 2008/0247787 A1 Oct. 9, 2008

(30) Foreign Application Priority Data

Jun. 15, 2005 (JP) ..... 2005-174683
Jun. 24, 2005 (JP) ..... 2005-185453

(51) Int. Cl.
*G08F 120/10* (2006.01)
*G03G 15/08* (2006.01)

(52) U.S. Cl. ..... 399/286; 430/110; 430/111; 430/137.17; 430/108.22; 526/312

(58) Field of Classification Search ..... 399/286; 526/312; 430/110, 111, 137.17, 108.22
See application file for complete search history.

(56) References Cited

U.S. PATENT DOCUMENTS

| | | | | |
|---|---|---|---|---|
| 5,262,264 | A | 11/1993 | Shimizu et al. | |
| 5,702,860 | A | 12/1997 | Koyama et al. | |
| 6,183,924 | B1 | 2/2001 | Nomura et al. | |
| 6,365,313 | B1 * | 4/2002 | Masuo et al. ..... | 430/108.22 |

FOREIGN PATENT DOCUMENTS

| | | | |
|---|---|---|---|
| JP | 2000-242033 | | 9/2000 |
| JP | 2002-244426 | | 8/2002 |
| JP | 2003-005507 | | 1/2003 |
| JP | 2005-031656 | | 2/2005 |
| JP | 2005-031657 | * | 2/2005 |

OTHER PUBLICATIONS

Korean Notification of Reason for Refusal dated Oct. 28, 2008 in Korean Application No. 10-2008-7001035, and an English-language translation thereof.
Written Opinion and International Search Report in International Application No. PCT/JP2006/311147.

* cited by examiner

*Primary Examiner*—Robert D. Harlan
(74) *Attorney, Agent, or Firm*—Fitzpatrick, Cella, Harper & Scinto

(57) ABSTRACT

To provide a positive charge control resin with which an electrophotographic functional component part coming into contact with a toner can be made chargeable in a polarity reverse to the polarity of the toner, and which has superior dispersibility in, and compatibility with, a main binder. The present invention is a positive charge control resin having a copolymer obtained by polymerizing specific acrylate or methacrylate monomer, amino-group-containing monomer(s) and carboxyl-group-containing monomer(s) as copolymerization components.

6 Claims, 3 Drawing Sheets

POSITIVE CHARGE CONTROL RESIN FOR ELECTROPHOTOGRAPHIC FUNCTIONAL COMPONENT PARTS, DEVELOPING ROLLER, AND ELECTROPHOTOGRAPHIC APPARATUS

TECHNICAL FIELD

This invention relates to a positive charge control resin for electrophotographic functional component parts used in making electrostatic latent images into visible images in dry-process electrophotography. It also relates to a developing roller making use of this resin, and an electrophotographic apparatus having the developing roller.

BACKGROUND ART

In the dry-process electrophotography, electrophotographic functional component parts such as a blade and a feed roller apply pressure or the like so that a toner is triboelectrically charged by the frictional force produced between the toner and the surfaces of such electrophotographic functional component parts to make the toner carried on other electrophotographic functional component part such as a developing roller. Accordingly, as a surface layer of an electrophotographic functional component part, it is necessary to select a negatively chargeable material when the toner should positively be charged, and a positively chargeable material when the toner should negatively be charged. As the former material, it is proposed to use a fluorine resin or the like, and as the latter material a nylon resin, a urethane resin or the like.

Meanwhile, in the electrophotographic functional component part, it is preferable to use a soft base material layer composed chiefly of a rubbery material, in order to, e.g., better secure the nip width and lessen the stress to toner. However, where such a chief soft base material layer is used, the frictional force alone which is produced between the toner and the electrophotographic functional component part surface may provide a small charge quantity, and it may be difficult to obtain good images by merely using the above fluorine resin, nylon resin or urethane resin proposed conventionally.

In order to resolve such a problem and taking account of intentionally improving charge characteristics of surface layers of electrophotographic functional component parts, a means is employed in which a charge control agent is added to electrophotographic functional component parts coming into contact with the toner. Recently, a method is proposed in which a charge control resin soluble in an organic solvent and capable of being coated on a developing roller or a developing sleeve is used as the charge control agent, and a method is reported in which it is used in a developing sleeve (e.g., Japanese Patent Applications Laid-open No. 2000-242033, No. 2002-244426 and No. 2003-005507). In all of these, a copolymer of an amino-group-containing acrylate or methacrylate monomer and methyl methacrylate is used as the charge control resin.

The present inventors have invented that the methyl methacrylate of the charge control resin disclosed in, e.g., the above Japanese Patent Applications Laid-open No. 2000-242033, No. 2002-244426 and No. 2003-005507 is replaced with an acrylate or methacrylate monomer having an alkyl group having 4 or more carbon atoms and this is copolymerized with an amino-group-containing monomer to obtain, when added to a base material resin, a charge control resin which can provide a larger charge quantity (Japanese Patent Applications Laid-open No. 2005-31656 and No. 2005-31657). It is considered that, when added to the base material resin, the alkyl group having 4 or more carbon atoms which is contained in the acrylate or methacrylate monomer prompts the surface orientation of amino groups contained in the amino-group-containing monomer, to promise a larger charge quantity.

The addition of the above charge control resin to the surface layer of the electrophotographic functional component part brings an improvement in image characteristics which is seen in virtue of the charge quantity made larger. It, however, has been found on the other hand that a difficulty on image characteristics which is due to the addition of such a charge control resin is seen depending on conditions of image evaluation.

DISCLOSURE OF THE INVENTION

An object of the present invention is to provide a positive charge control resin with which an electrophotographic functional component part coming into contact with a toner can be made chargeable in a polarity reverse to the polarity of the toner, and which can keep the difficulty from coming about that is due to the addition of the charge control resin to the surface layer of an electrophotographic functional component part, and has superior dispersibility in, and compatibility with, a main binder, and provide an electrophotographic functional component part containing such a positive charge control resin.

The present inventors have further continued to make studies, and have discovered that a carboxyl-group-containing monomer may be copolymerized in addition to an acrylate or methacrylate monomer and an amino-group-containing monomer and this can keep the difficulty from coming about that is due to the addition of the charge control resin to the surface layer of the electrophotographic functional component part.

The present invention is concerned with a positive charge control resin comprising a copolymer obtained by polymerizing as copolymerization components an acrylate or methacrylate, monomer represented by Formula (1), an amino-group-containing monomer(s) represented by Formula (2) and/or Formula (3), and a carboxyl-group-containing monomer(s) represented by Formula (4) and/or Formula (5):

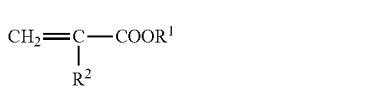

(1)

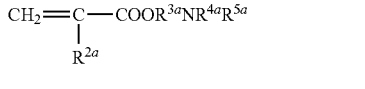

(2)

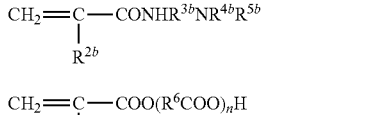

(3)

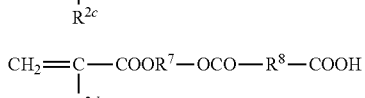

(4)

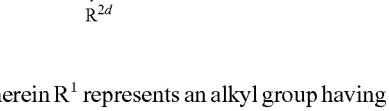

(5)

wherein $R^1$ represents an alkyl group having 4 or more carbon atoms or a fluoroalkyl group having 1 to 14 carbon atoms which has 3 or more fluorine atoms; $R^2$, $R^{2a}$, $R^{2b}$, $R^{2c}$ and $R^{2d}$ each independently represent a hydrogen atom or a methyl group; $R^{3a}$ and $R^{3b}$ each independently represent a divalent organic group having 1 to 7 carbon atoms; $R^{4a}$, $R^{4b}$, $R^{5a}$ and $R^{5b}$ each independently represent a hydrogen atom, an organic group having 1 to 20 carbon atoms, or a divalent organic group having 4 to 20 carbon atoms in which $R^{4a}$ and $R^{5a}$, or $R^{4b}$ and $R^{5b}$, have chemically combined, or a divalent organic group having 4 to 19 carbon atoms which contains at least one of an oxygen atom, a nitrogen atom and a sulfur atom and in which $R^{4a}$ and $R^{5a}$, or $R^{4b}$ and $R^{5b}$, have chemically combined; $R^6$ represents an alkylene group having 2 to 6 carbon atoms; $R^7$ represents an alkylene group having 2 to 4 carbon atoms; $R^8$ represents an ethylene group, a vinylene group, a 1,2-cyclohexylene group or a 1,2-phenylene group; and n represents an integer of 0 to 10.

The present invention is also concerned with a developing roller comprising a conductive shaft and provided on the outer periphery of the conductive shaft an elastic layer and at least one covering layer in this order, which is a developing roller which carries on the surface thereof a negatively chargeable developer formed in a thin layer and brings the thin-layer negatively chargeable developer into contact with or proximity to an electrostatic image bearing member to develop an electrostatic latent image formed on the electrostatic image bearing member, wherein the covering layer contains the above positive charge control resin.

The present invention is further concerned with an electrophotographic apparatus comprising an electrostatic image bearing member, a charging assembly for charging the surface of the electrostatic image bearing member electrostatically, an electrostatic latent image forming assembly for forming an electrostatic latent image in the charged area of the electrostatic image bearing member, a developing assembly for feeding a negatively chargeable developer to the electrostatic latent image formed on the surface of the electrostatic image bearing member to render the electrostatic latent image visible to form a developer image, and a transfer assembly for transferring the developer image to a transfer material, wherein a developing roller the developing assembly has is the above developing roller.

The positive charge control resin of the present invention makes it possible to keep the difficulty from coming about that is due to the addition of the charge control resin to the surface layer of an electrophotographic functional component part, has superior dispersibility in, and compatibility with, a main binder, can make an electrophotographic functional component part coming into contact with a toner chargeable in a polarity reverse to the polarity of the toner, and can achieve a good charging performance. In its use in an electrophotographic apparatus member, good images can be obtained.

BEST MODE FOR CARRYING OUT THE INVENTION

Figure 1A:
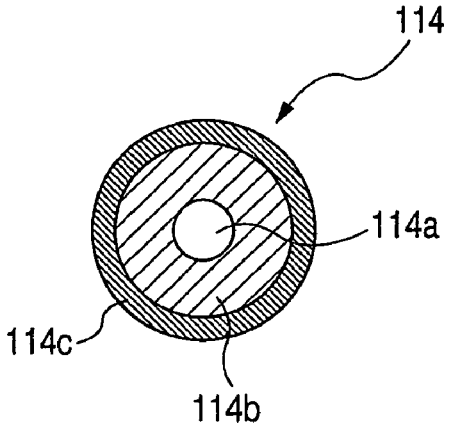
FIG. 1A is a sectional view showing the basic construction of the developing roller of the present invention.

According to studies made by the present inventors, it has been found that, although detailed reasons are unclear, the use of a positive charge control resin comprising a copolymer obtained by polymerizing, as copolymerization components, an acrylate or methacrylate monomer represented by Formula (1) and an amino-group-containing monomer(s) represented by Formula (2) and/or Formula (3), and, in addition thereto, a carboxyl-group-containing monomer(s) represented by Formula (4) and/or Formula (5) remarkably brings out the effect on achieving both the charge quantity made larger that is due to the addition of the charge control resin to the surface layer of an electrophotographic functional component part and the keeping of the difficulty from coming about that is due to the addition of the same.

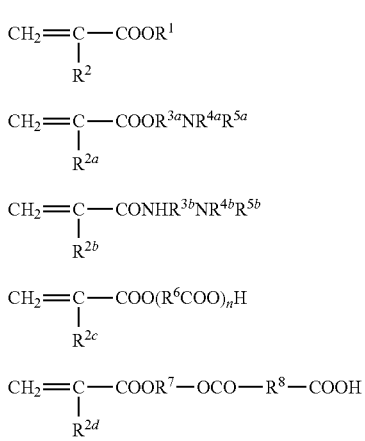

(1)

(2)

(3)

(4)

(5)

In Formulas, $R^1$ represents an alkyl group having 4 or more carbon atoms or a fluoroalkyl group having 1 to 14 carbon atoms which has 3 or more fluorine atoms; $R^2$, $R^{2a}$, $R^{2b}$, $R^{2c}$ and $R^{2d}$ each independently represent a hydrogen atom or a methyl group; $R^{3a}$ and $R^{3b}$ each independently represent a divalent organic group having 1 to 7 carbon atoms; $R^{4a}$, $R^{4b}$, $R^{5a}$ and $R^{5b}$ each independently represent a hydrogen atom, an organic group having 1 to 20 carbon atoms, or a divalent organic group having 4 to 20 carbon atoms in which $R^{4a}$ and $R^{5a}$, or $R^{4b}$ and $R^{5b}$, have chemically combined, or a divalent organic group having 4 to 19 carbon atoms which contains at least one of an oxygen atom, a nitrogen atom and a sulfur atom and in which $R^{4a}$ and $R^{5a}$, or $R^{4b}$ and $R^{5b}$, have chemically combined; $R^6$ represents an alkylene group having 2 to 6 carbon atoms; $R^7$ represents an alkylene group having 2 to 4 carbon atoms; $R^8$ represents an ethylene group, a vinylene group, a 1,2-cyclohexylene group or a 1,2-phenylene group; and n represents an integer of 0 to 10.

The acrylate or methacrylate monomer represented by Formula (1) in which $R^1$ is an alkyl group having 4 or more carbon atoms may specifically include, e.g., n-butyl acrylate or methacrylate, tert-butyl acrylate or methacrylate, iso-butyl acrylate or methacrylate, n-amyl acrylate or methacrylate, n-hexyl acrylate or methacrylate, cyclohexyl acrylate or methacrylate, 2-ethylhexyl acrylate or methacrylate, n-octyl acrylate or methacrylate, iso-octyl acrylate or methacrylate, n-noyl acrylate or methacrylate, n-nonyl acrylate or methacrylate, n-decyl acrylate or methacrylate, iso-decyl acrylate or methacrylate, n-lauryl acrylate or methacrylate, n-tridecyl acrylate or methacrylate, n-stearyl acrylate or methacrylate, and isobornyl acrylate or methacrylate. The acrylate or methacrylate monomer represented by Formula (1) in which $R^1$ is a fluoroalkyl group having 1 to 14 carbon atoms which has 3 or more fluorine atoms may specifically include, e.g., 2,2,2-trifluoroethyl acrylate or methacrylate, 2,2,3,3,3-pentafluoropropyl acrylate or methacrylate, 2,2,3,3,4,4,4-heptafluorobutyl acrylate or methacrylate, 2,2,3,3,4,4,5,5,5-nonafluoropentyl acrylate or methacrylate, 2,2,3,3,4,4,5,5,6,6,6-undecafluorohexyl acrylate or methacrylate, 2,2,3,3,4,4,5,5,6,6,7,7,7-tridecafluoroheptyl acrylate or methacrylate, 2,2,3,3,4,4,5,5,6,6,7,7,8,8,8-pentadecafluorooctyl acrylate or methacrylate, 3,3,4,4,5,5,6,6,7,7,8,8,8-tridecafluorooctyl acrylate or methacrylate, 2,2,3,3,4,4,5,5,6,6,7,7,8,8,9,9,10,10,10-nonadecafluorodecyl acrylate or methacrylate, 3,3,4,4,5,5,6,6,7,7,8,8,9,9,10,10,10-heptadecafluorodecyl acrylate or methacrylate, 2-trifluoromethyl-3,3,3-trifluoropropyl acrylate or methacrylate, 3-trifluoromethyl-4,4,4-trifluorobutyl acrylate or methacrylate, 1-methyl-2,2,3,3,3-pentafluoropropyl acrylate or methacrylate, 1-methyl-2,2,3,3,4,4,4-heptafluorobutyl acrylate or methacrylate, 2,2,3,3-tetrafluoropropyl acrylate or methacrylate, 2,2,3,3,4,4-hexafluorobutyl acrylate or methacrylate, 2,2,3,3,4,4,5,5-octafluoropentyl acrylate or methacrylate, 2,2,3,3,4,4,5,5,6,6-decafluorohexyl acrylate or methacrylate, 2,2,3,3,4,4,5,5,6,6,7,7-dodecafluoroheptyl acrylate or methacrylate, 2,2,3,3,4,4,5,5,6,6,7,7,8,8-tetradecafluorooctyl acrylate or methacrylate, 3,3,4,4,5,5,6,6,7,7,8,8-dodecafluorooctyl acrylate or methacrylate; 2,2,3,3,4,4,5,5,6,6,7,7,8,8,9,9,10,10-octadecafluorodecyl acrylate or methacrylate, and 3,3,4,4,5,5,6,6,7,7,8,8,9,9,10,10-hexadecafluorodecyl acrylate or methacrylate. Any of these monomers may be used alone or in combination of two or more types.

The amino-group-containing monomer represented by Formula (2) may include, e.g., N,N-dimethylaminomethyl acrylate or methacrylate, N,N-diethylaminomethyl acrylate or methacrylate, N,N-dimethylaminoethyl acrylate or methacrylate, N,N-diethylaminoethyl acrylate or methacrylate, N,N-dimethylaminopropyl acrylate or methacrylate, N,N-dimethylaminobutyl acrylate or methacrylate, p-N,N-dimethylaminophenyl acrylate or methacrylate, p-N,N-diethylaminophenyl acrylate or methacrylate, p-N,N-dipropylaminophenyl acrylate or methacrylate, p-N,N-dibutylaminophenyl acrylate or methacrylate, p-N-laurylaminophenyl acrylate or methacrylate, p-N-stearylaminophenyl acrylate or methacrylate, p-N,N-dimethylaminobenzyl acrylate or methacrylate, p-N,N-diethylaminobenzyl acrylate or methacrylate, p-N,N-dipropylaminobenzyl acrylate or methacrylate, p-N,N-dibutylaminobenzyl acrylate or methacrylate, p-N-laurylaminobenzyl acrylate or methacrylate, and p-N-stearylaminobenzyl acrylate or methacrylate. Any of these monomers may be used alone or in combination of two or more types.

The amino-group-containing monomer represented by Formula (3) may include, e.g., N,N-dimethylaminoethyl acrylamide or methacrylamide, N,N-diethylaminoethyl acrylamide or methacrylamide, N,N-dimethylaminopropyl acrylamide or methacrylamide, N,N-diethylaminopropyl acrylamide or methacrylamide, p-N,N-dimethylaminophenyl acrylamide or methacrylamide, p-N,N-diethylaminophenyl acrylamide or methacrylamide, p-N,N-dipropylaminophenyl acrylamide or methacrylamide, p-N,N-dibutylaminophenyl acrylamide or methacrylamide, p-N-laurylaminophenyl acrylamide or methacrylamide, p-N-stearylaminophenyl acrylamide or methacrylamide, p-N,N-dimethylaminobenzyl acrylamide or methacrylamide, p-N,N-diethylaminobenzyl acrylamide or methacrylamide, p-N,N-dipropylaminobenzyl acrylamide or methacrylamide, p-N,N-dibutylaminobenzyl acrylamide or methacrylamide, p-N-laurylaminobenzyl acrylamide or methacrylamide, and p-N-stearylaminobenzyl acrylamide or methacrylamide. Any of these monomers may be used alone or in combination of two or more types.

Incidentally, as the amino-group-containing monomer(s) represented by Formula (2) and/or Formula (3), only the amino-group-containing monomer represented by Formula (2) may be used, only the amino-group-containing monomer represented by Formula (3) may be used, or the amino-group-containing monomer represented by Formula (2) and the amino-group-containing monomer represented by Formula (3) may be used in combination.

The carboxyl-group-containing monomer represented by Formula (4) may include, e.g., acrylic or methacrylic acid, an acrylic or methacrylic acid dimer, and ω-carboxy-polycarpolactone monoacrylate or -methacrylate (provided that the caprolactone units are 10 or less).

The carboxyl-group-containing monomer represented by Formula (5) may include, e.g., 2-acryloyloxy or -methacryloyloxyethylsuccinic acid, 2-acryloyloxy or -methacryloyloxyethylmaleic acid, 2-acryloyloxy or -methacryloyloxyethylfumaric acid, 2-acryloyloxy or -methacryloyloxyethylphtharic acid, 2-acryloyloxy or -methacryloyloxyethylhexahydrophtharic acid.

Incidentally, as the carboxyl-group-containing monomer(s) represented by Formula (4) and/or Formula (5), only the carboxyl-group-containing monomer represented by Formula (4) may be used, only the carboxyl-group-containing monomer represented by Formula (5) may be used, or the carboxyl-group-containing monomer represented by Formula (4) and the carboxyl-group-containing monomer represented by Formula (5) may be used in combination.

The positive charge control resin of the present invention may preferably have an amino value of 5 mgKOH/g or more and 350 mgKOH/g or less, more preferably 15 mgKOH/g or more and 345 mgKOH/g or less, and still more preferably 30 mgKOH/g or more and 340 mgKOH/g or less. If the positive charge control resin has an amino value of less than 5 mgKOH/g, it may provide an insufficient charge quantity. If it has an amino value of more than 350 mgKOH/g, it tends to have a low compatibility with the main binder to provide an insufficient charge quantity, undesirably.

The positive charge control resin of the present invention may preferably have an acid value of 0.1 mgKOH/g or more and 150 mgKOH/g or less, more preferably 0.5 mgKOH/g or more and 145 mgKOH/g or less, and still more preferably 1 mgKOH/g or more and 140 mgKOH/g or less. If the positive charge control resin has an acid value of less than 0.1 mgKOH/g, the difficulty that is due to its addition may insufficiently be kept from coming about. If it has an acid value of more than 150 mgKOH/g, it may provide an insufficient charge quantity, undesirably.

The positive charge control resin of the present invention may preferably have a weight-average molecular weight (Mw) of 2,000 or more and 500,000 or less, more preferably 3,000 or more and 300,000 or less, and still more preferably 5,000 or more and 200,000 or less. If it has a weight-average molecular weight (Mw) of less than 2,000, it may bleed out with time, undesirably. If it has a weight-average molecular weight (Mw) of more than 500,000, it has a low compatibility with the main binder, undesirably.

The positive charge control resin of the present invention may preferably have a glass transition temperature (Tg) of −100° C. or higher and 180° C. or lower, more preferably −90° C. or higher and 170° C. or lower, and still more preferably −80° C. or higher and 160° C. or lower. If it has a glass transition temperature (Tg) of less than −100° C., it may give a high tackiness and also a large coefficient of friction, undesirably. If it has a glass transition temperature (Tg) of more than 180° C., the positive charge control resin may be dispersed in the main binder in a non-uniform state, undesirably.

A polymerization process for obtaining the positive charge control resin of the present invention may include, but is not particularly limited to, bulk polymerization, solution polymerization, emulsion polymerization and suspension polymerization. In view of an advantage that the reaction is readily controllable, the solution polymerization is preferred. As solvents therefor, usable are, but not particularly limited to, xylene, toluene, ethyl acetate, isobutyl acetate, isopropyl alcohol, methanol, methyl ethyl ketone, methyl isobutyl ketone, N,N-dimethylformamide, and dimethylformamide. The polymerization may preferably be carried out in a solvent/monomer ratio of, but not particularly limited to, 30 parts by mass or more and 400 parts by mass or less of the monomers based on 100 parts by mass of the solvent.

A polymerization initiator used in the polymerization to obtain the positive charge control resin of the present invention may include, but is not particularly limited to, t-butyl peroxy-2-ethylhexanoate, cumyl perpivarate, t-butyl peroxylaurate, benzoyl peroxide, lauroyl peroxide, octanoyl peroxide, di-t-butyl peroxide, di-t-butyl cumylperoxide, dicumyl peroxide, 2,2'-azobisisobutyronitrile, 2,2'-azobis(2-methylbutyronitrile, 2,2'-azobis(2,4-dimethylvaleronitrile), 2,2'-azobis(4-methoxy-2,4-dimethylvaleronitrile), and dimethyl 2,2'-azobis(2-methylpropionate). Any of these may be used alone or in combination.

The polymerization initiator may be used in a concentration of 0.05 part by mass or more and 30 parts by mass or less, and preferably 0.1 part by mass or more and 15 parts by mass or less, based on 100 parts by mass of the monomers. As the polymerization temperature, it may be set without any particular limitations, in accordance with the solvent; initiator and monomers to be used. The polymerization may preferably be carried out at 40° C. or higher and 150° C. or lower.

Meanwhile, the developing roller of the present invention comprises a conductive shaft and provided on the outer periphery of the conductive shaft an elastic layer and at least one covering layer in this order. The covering layer to be a surface layer contains a positive charge control resin. Then, it is used as a developing roller which carries on the surface thereof a negatively chargeable developer formed in a thin layer and brings the thin-layer negatively chargeable developer into contact with or proximity to an electrostatic image bearing member to develop an electrostatic latent image formed on the electrostatic image bearing member. In virtue of this positive charge control resin, the developing roller can be a developing roller the covering layer surface of which is made chargeable in a polarity reverse to the polarity of the toner, and which has a superior toner charging performance and can keep the difficulty from coming about that is due to the addition of the positive charge control resin.

Figure 1B:
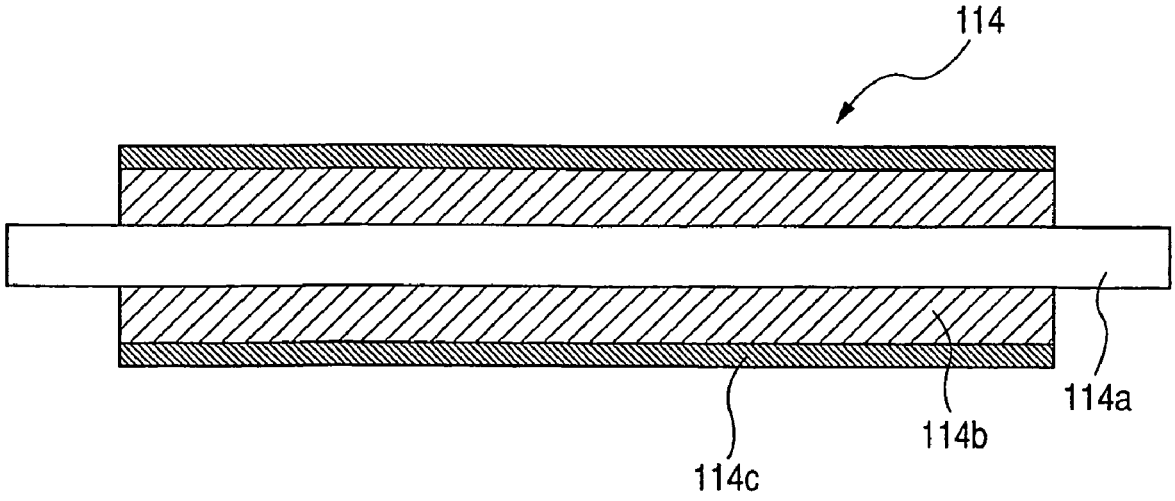
FIG. 1B is another sectional view showing the basic construction of the developing roller of the present invention.

FIGS. 1A and 1B schematically illustrate an embodiment of the developing roller of the present invention. FIG. 1B is a schematic sectional view along the axis of the developing roller. FIG. 1A is a view in which the developing roller is viewed in the axial direction. A developing roller 114 according to the embodiment shown in these drawings comprises a shaft 114*a* serving as the conductive shaft and provided on the outer periphery thereof an elastic layer 114*b* and a surface layer, covering layer 114*c* in this order.

The shaft 114*a* may be one having a strength high enough to be durable at the time of molding or forming and at the time of actual service. It may preferably have an outer diameter of from 4 to 10 mm. As a material for the shaft 114*a*, it may include rigid and conductive materials as exemplified by metals such as iron, aluminum, titanium, copper and nickel; alloys containing any of these metals, such as stainless steel, duralmin, brass and bronze; and also composite materials composed of carbon black or carbon fiber hardened with a plastic.

The elastic layer 114*b* may be one formed of any known material. Usable are, e.g., rubber materials such as natural rubber, silicone rubber, urethane rubber, ethylene-propylene rubber, butadiene rubber, chloroprene rubber, neoprene rubber, isoprene rubber and nitrile rubber (NBR) to which any of carbon black, graphite, conductive particles, conductive rubber and the like has or have been added. There are no particular limitations on how to form the elastic layer, and any known method may be used. For example, usable are methods such as a method in which the shaft is set in a mold and the rubber material is casted into it, followed by hot forming to provide the elastic layer on the outer periphery of the shaft, and a method in which the shaft is covered on its outer periphery with an elastic rubber material formed separately. It is preferable for the elastic layer 114*b* to have conductivity. It is also preferable for the elastic layer 114*b* to have a thickness of 2.0 mm or more and 10 mm or less. Inasmuch as the elastic layer 114*b* has a thickness of 2.0 mm or more, it can readily have a sufficiently low hardness, and, inasmuch as it has a thickness of 10 mm or less, it can have an appropriate resistivity. Thus, such thickness is preferable.

The covering layer 114*c* serves as the surface layer of the developing roller 114. It is formed using a covering layer constituent material prepared by mixing the above positive charge control resin in a base material resin. Such a covering layer constituent material may preferably contain the positive charge control resin in an amount of 0.01 part by mass or more and 50 parts by mass or less, and more preferably 0.1 part by mass or more and 30 parts by mass or less, based on 100 parts by mass of the base material resin.

As the base material resin, any known resin may be used, which may include, e.g., styrene resins (homopolymers, or copolymers, containing styrene or a styrene derivative), acrylic resins (homopolymers, or copolymers, containing an acrylate or methacrylate), vinyl chloride resin, styrene-vinyl acetate copolymer, rosin modified maleic acid resin, phenolic resin, epoxy resin, polyester resin, fluorine resin, low-molecular weight polyethylene, low-molecular weight polypropylene, ionomer resin, polyurethane resin, nylon resin, silicone resin, ketone resin, ethylene-ethyl acrylate copolymer, xylene resin and polyvinyl butyral resin. As a base material resin particularly preferable in practicing the present invention, it may include urethane resin, nylon resin, acrylic resin and fluorine resin, because the developing roller is required to have wear resistance, toner charging performance and toner transport performance. The base material resin may be used alone or in combination of two or more types.

It is also preferable to add carbon black in order to control conductivity. The carbon black used for such purpose may include, e.g., furnace black, lamp black, thermal black, acetylene black and channel black. The amount of the carbon black used in the covering layer constituent material may appropriately be set in accordance with the properties of the intended developing roller. For example, the carbon black may be incorporated in an amount of 1 part by mass or more and 40 parts by mass or less based on 100 parts by mass of the base material resin.

To the covering layer constituent material, it is still also preferable to add, as a surface roughening material, insulating particles having an average particle diameter of 5 μm or more and 30 μm or less, as exemplified by urethane particles, nylon particles, acrylate particles and silicone particles. The amount of the surface roughening material to be added to the covering layer constituent material may appropriately be set in accordance with the properties of the intended developing roller. For example, the surface roughening material may be incorporated in an amount of 1 part by mass or more and 60 parts by mass or less based on 100 parts by mass of the base material resin.

There are no particular limitations on how to form the covering layer, and any known method may be used, as exemplified by a method making use of molding or coating. For example, as the method making use of coating, a method may preferably be used in which the covering layer constituent material containing the components described above is dispersed in a solvent by means of a conventionally known dispersion apparatus making use of beads, such as a sand mill, a paint shaker, Dyno mill or Pearl mill, and, after it has been dispersed, a curing agent or a curing catalyst is added, followed by stirring to prepare a coating fluid for forming the covering layer, then the coating fluid thus obtained is coated on the elastic layer surface by spray coating, dipping or the like, followed by drying and curing to form the covering layer. As the solvent, usable are, e.g., methyl ethyl ketone, toluene and alcohol.

The covering layer may preferably be formed in a thickness of from 2 μm or more and 100 μm or less, taking account of achieving wear resistance without damaging the flexibility of the elastic layer.

The above example is a developing roller having one covering-layer, which may also be a developing roller having two or more covering layers. In the latter case, the positive charge control resin described above may be contained at least in a covering layer that forms the surface layer. In the case of an embodiment in which the positive charge control resin is not contained in a covering layer(s) positioned inside the surface layer, the covering layer(s) may be constituted in the same way as the above except that the positive charge control resin is not contained. Two or more covering layers may be constituted alike or may be constituted in a different way in regard to the components, composition and so forth of the covering layer constituent material to be used.

The electrophotographic apparatus of the present invention is described next. The electrophotographic apparatus of the present invention is characterized in that a developing roller a developing assembly has is the above developing roller of the present invention. Stated specifically, it is an electrophotographic apparatus comprising an electrostatic image bearing member, a charging assembly for charging the surface of the electrostatic image bearing member electrostatically, an electrostatic latent image forming assembly for forming an electrostatic latent image in the charged area of the electrostatic image bearing member, a developing assembly for feeding a negatively chargeable developer to the electrostatic latent image formed on the surface of the electrostatic image bearing member to render the electrostatic latent image visible to form a developer image, and a transfer assembly for transferring the developer image to a transfer material, wherein a developing roller the developing assembly has is the above developing roller of the present invention. Such an electrophotographic apparatus of the present invention promises superior image characteristics and can form good images.

Figure 2:
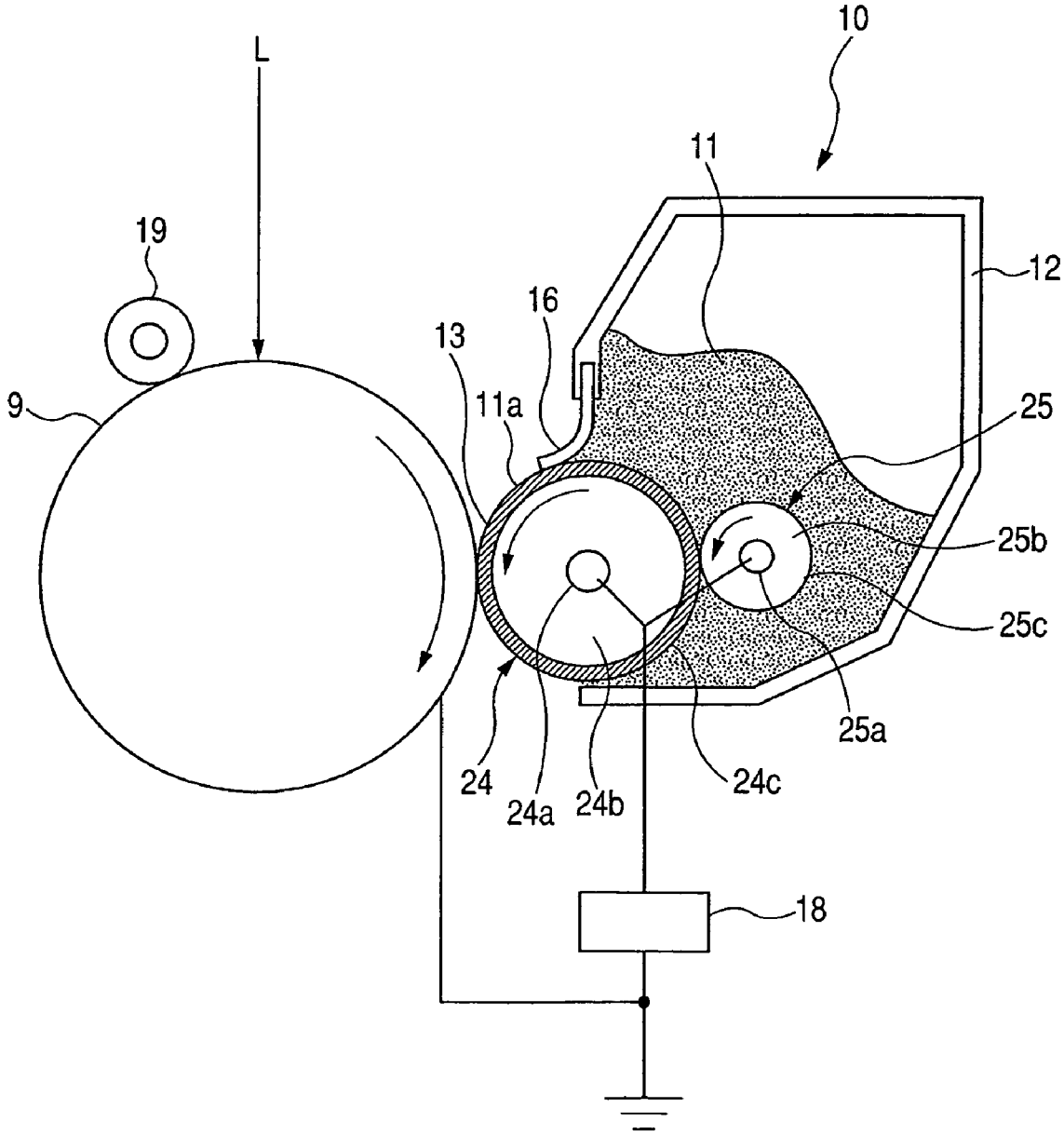
FIG. 2 is a schematic view showing the construction of a laser beam printer having the developing roller of the present invention.

The electrophotographic apparatus (a laser beam printer) of the present invention is constructed as schematically shown in FIG. 2. In what is shown in FIG. 2, a developing assembly 10 of the laser beam printer employs a non-magnetic one-component developing system. In its developer container 12, a developer 11 (a one-component developer composed of a negatively chargeable non-magnetic toner) is held. A developing roller 24 is disposed at an opening of the developer container 12, which faces a photosensitive drum 9 serving as the electrostatic image bearing member, and in such a way that it comes into contact with the photosensitive drum 9. The developing roller 24 is, as described previously, constituted of a shaft 24*a* and formed thereon an elastic layer 24*b* and a covering, layer 24*c*. A feed roller 25 constituted of a shaft 25*a* and formed thereon an elastic layer 25*b* and a covering layer 25*c* is also disposed in such a state that it can feed the developer 11 to the developing roller 24.

This developing roller 24 and the feed roller 25 are rotated in the directions of arrows, whereupon the developer 11 held in the developer container 12 is carried on the developing roller 24. The developer 11 carried thereon is controlled by means of a blade 16, so that a thin layer 11*a* of the developer is formed on the developing roller 24, and this developer is transported to a developing zone 13 facing the photosensitive drum 9. Meanwhile, the surface of the photosensitive drum 9 is primarily electrostatically charged by means of a charging roller 19 the charging assembly has, and electrostatic latent images are kept formed thereon by the aid of a laser beam L emitted from a laser beam emitting means the electrostatic latent image forming assembly has. Across the developing roller 24 and the photosensitive drum 9, a development bias is kept applied from a constant-voltage power source 18, and the developer is fed to the electrostatic latent images formed on the photosensitive drum 9, to render the electrostatic latent images visible (i.e., develop the electrostatic latent images), so that developer images are formed. Thereafter, the developer images are transferred to a transfer material by means of a transfer assembly (not shown), and then fixed by means of a fixing assembly (not shown). The transfer material having images having been thus fixed are delivered out of the apparatus.

EXAMPLES

The present invention is described below in greater detail by giving Examples. The present invention is by no means limited to these Examples. Structural formulas of acrylate or methacrylate monomers A1, A2 and A3 used in Examples are shown as (6), (7) and (8), respectively; structural formulas of amino-group-containing monomers B1 and B2, as (9) and (10), respectively; and structural formulas of carboxyl-group-containing monomers C1 and C2, as (11) and (12), respectively. Incidentally, the carboxyl-group-containing monomer C2 is a mixture of the compound of n=1 and the compound of n=2; their average value being n=1.4.

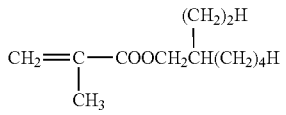

(6)

(A1)

-continued

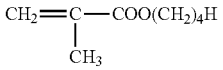

(7)

(A2)

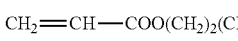

(8)

(A3)

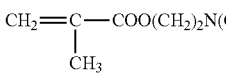

(9)

(B1)

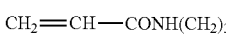

(10)

(B2)

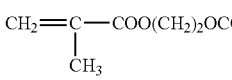

(11)

(C1)

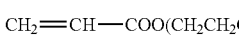

(12)

(C2)

Example 1

Production of Positive Charge Control Resin CCR1 and Evaluation of Physical Properties Into a four-necked separable flask provided with a stirrer, a condenser, a thermometer and a nitrogen feed pipe, 20 g of 2-ethylhexyl methacrylate (A1), 25 g of N,N-dimethylaminoethyl methacrylate (B1) and 5 g of 2-methacryloyloxyethylsuccinic acid (C1) as copolymerization monomers, 37.5 g of toluene and 12.5 g of ethanol as solvents and 2.0 g of dimethyl 2,2'-azobis(2-methylpropionate) as a polymerization initiator were introduced. Stirring these, solution polymerization was carried out at 80° C. for 8 hours in an atmosphere of nitrogen to obtain a solution of Positive Charge Control Resin CCR1. Thereafter, a portion of the solution obtained was dried under reduced pressure to obtain Positive Charge Control Resin CCR1. Using this, physical properties of Positive Charge Control Resin CCR1 were evaluated.

The amino value and acid value, and weight average molecular weight (Mw) and Tg, of Positive Charge Control Resin CCR1 obtained were respectively measured with a full-automatic titrator (AT-510, trade name, manufactured by Kyoto Electronics Manufacturing Co., Ltd.), by GPC (gel permeation chromatography) (instrument: HLC-8120GPC, trade name, manufactured by Toso Corporation; columns: KF-805L, trade name, two columns, available from Showa Denko K.K.), and by DSC (differential scanning calorimetry) (instrument: DSC6200, trade name, manufactured by Seiko Instruments Inc.). The results are shown in Table 1.

Production of Developing Roller 1

A shaft (made of SUM (free cutting carbon steels)) of 8 mm in outer diameter was concentrically set in a cylindrical mold of 16 mm in inner diameter, and liquid conductive silicone rubber (available from Dow Corning Toray Silicone Co., Ltd.; Asker-C hardness: 35 degrees; volume resistivity: $10\times10^9$ Ωcm was casted into the mold. Thereafter, this was put into a 130° C. oven to carry out hot forming for 20 minutes. The molded product obtained was demolded and thereafter secondarily vulcanized for 4 hours in a 200° C. oven. Thus, an elastic layer of 4 mm in thickness was formed around the shaft.

Next, a urethane coating material (trade name: NIPPOLAN N5033; available from Nippon Polyurethane Industry Co., Ltd.) was so diluted with methyl ethyl ketone as to be in a solid-matter concentration of 10%. To this urethane coating material, based on 100 parts by mass of its solid content, 10 parts by mass of Positive Charge Control Resin CCR1, 50 parts by mass of carbon black (trade name: #7360SB; available from Tokai Carbon Co., Ltd.) as a conducting agent and 6 parts by mass of urethane particles of 14 μm in average particle diameter (trade name: ART PEARL C400; available from Negami Chemical Industrial Co., Ltd.) as a surface roughening agent were added, and the respective components were thoroughly dispersed. To the dispersion obtained, a curing agent (a modified TDI (tolylene diisocyanate)), trade name: COLONATE L; available from Nippon Polyurethane Industry Co., Ltd.) was added in an amount of 10 parts by mass based on 100 parts by mass of the solid matter of the urethane coating material, followed by stirring to obtain a coating fluid, which was then coated by dipping on the elastic layer formed previously, being so coated as to give a layer thickness of 20 μm when dried and cured in the following way. The wet coating formed was dried for 15 minutes in a 80° C. oven, and thereafter cured for 4 hours in a 140° C. oven to form a covering layer to obtain Developing Roller 1.

Charge Quantity of Inclined Plate Method

Measurement of Surface Layer

The above surface layer forming coating material was uniformly applied on a SUS stainless steel plate, and the wet coating formed was dried for 15 minutes in a 80° C. oven, followed by curing for 4 hours in a 140° C. oven to produce a sample plate for charge quantity measurement.

Figure 3:
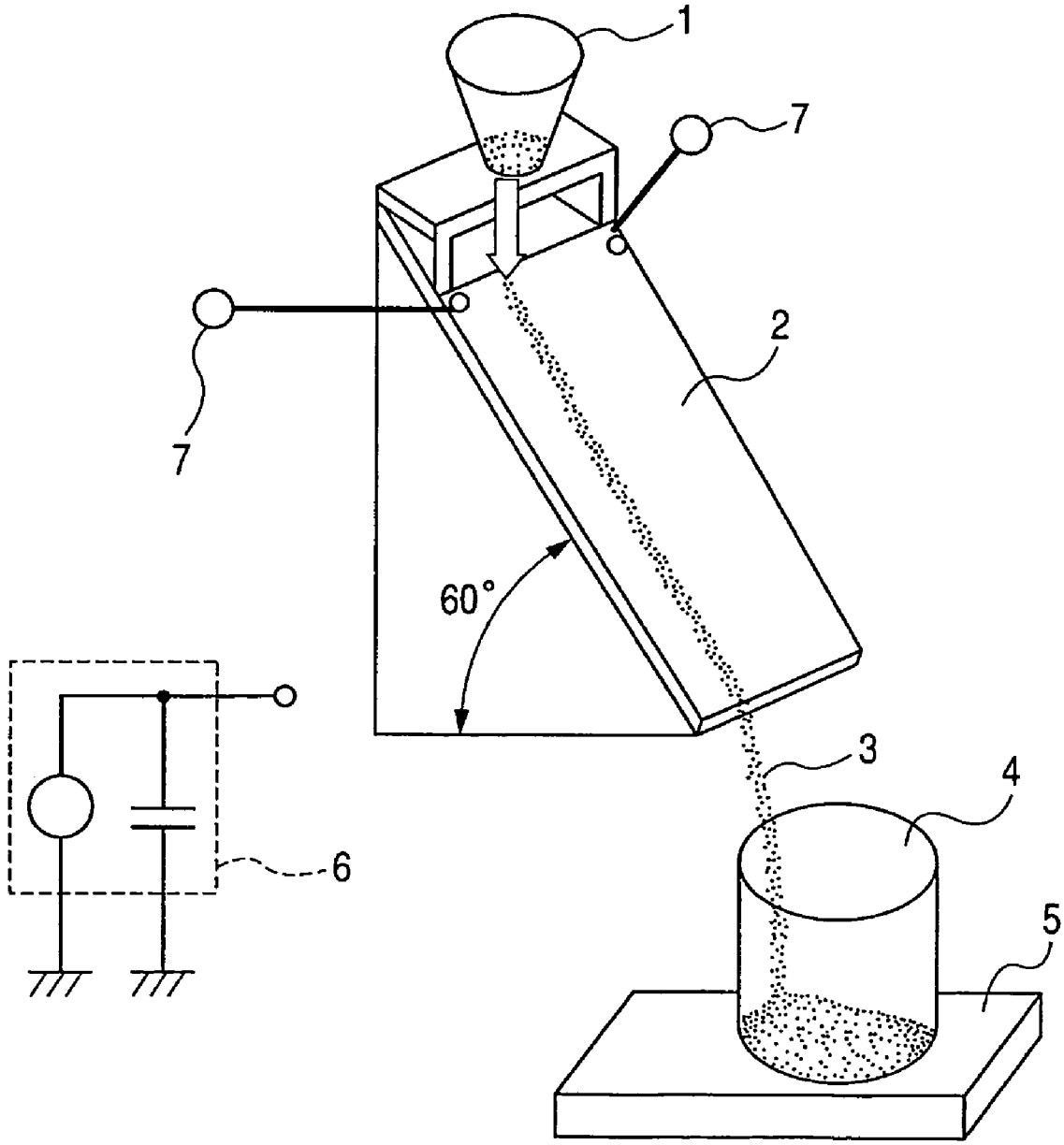
FIG. 3 is a schematic view of an instrument used in charge quantity of inclined plate method measurement.

The charge quantity of inclined plate method measurement was made in a normal-temperature and normal-humidity environment (N/N) (22° C., 55% RH) and using a cascade type surface charge quantity measuring instrument (manufactured by Toshiba Chemical Corporation), the instrument shown in FIG. 3. In FIG. 3, reference numeral 1 denotes a reference powder feed hopper; 2, an inclined plate (a sample stand); 3, a reference powder; 4, a receiver; 5, an insulating plate; 6, an electrometer; and 7, a meter connecting terminal.

First, the mass of the receiver 4 was weighed, and was represented by $W_1$ (g). The measuring sample plate was fastened to the inclined plate 2, having an angle of inclination of 60 degrees, and the reference powder 3 was allowed to fall from the reference powder feed hopper 1 for 20 seconds. After the reference powder fell, the electric charge of the measuring sample plate was measured with the electrometer 6, and was represented by Q (μC). Also, the mass of the whole receiver 4 was weighed, and was represented by $W_2$ (g). The charge quantity of inclined plate method was calculated according to the following expression to obtain the results shown in Table 2.

Charge Quantity of Inclined Plate Method (μC/G)=$Q/(W_2-W_1)$

Evaluation of Developing Roller 1

Developing Roller 1 obtained as described above was attached to an evaluation-purpose laser beam printer making use of a one-component developer composed of a negatively chargeable non-magnetic toner, and stated images (character pattern images) were continuously printed on 18,000 sheets in a high-temperature and high-humidity environment (H/H) (32.5° C., 80% RH). Thereafter, the charge quantity of the toner adhering to the surface of the developing roller was measured and image density and fogging were evaluated by the methods described later.

A low-temperature and low-humidity environment (L/L) (15° C., 10% RH) was also made up, where initial-stage images were printed. Thereafter, evaluation was made on any toner scattering around images (spots around line images) and mottle (blotchy image non-uniformity appearing in solid black and halftone images during running) by the methods described later.

The results are shown in Table 3.

Examples 2 to 5

Production of Positive Charge Control Resins CCR2 to CCR5 and Evaluation of Physical Properties Positive Charge Control Resins CCR2 to CCR5 were obtained in the same manner as in the production of the positive charge control resin of Example 1 except that the acrylate or methacrylate monomer, the amino-group-containing monomer and the carboxyl-group-containing monomer were used as shown in Table 1. The amino value, acid value, weight average molecular weight (Mw) and Tg of Positive Charge Control Resins CCR2 to CCR5 obtained were respectively evaluated in the same way as the evaluation of physical properties of the positive charge control resin of Example 1. The results are shown in Table 1.

Production of Developing Rollers 2 to 5

Developing Rollers 2 to 5 were produced in the same manner as in Example 1 except that Positive Charge Control Resins CCR2 to CCR5 were used, respectively, in place of CCR1.

Charge Quantity of Inclined Plate Method

Measurement of Surface Layer

Evaluated in the same way as in Example 1. The results are shown in Table 2.

Evaluation of Developing Rollers 2 to 5

Evaluated in the same way as in Example 1. The results are shown in Table 3.

Comparative Examples 1 & 2

Production of Positive Charge Control Resins CCR6 and CCR7 and Evaluation of Physical Properties Positive Charge Control Resins CCR6 and CCR7 were obtained in the same manner as in the production of the positive charge control resin of Example 1 except that the acrylate or methacrylate monomer, the amino-group-containing monomer and the carboxyl-group-containing monomer were used as shown in Table 1. The amino value, acid value, weight average molecular weight (Mw) and Tg of Positive Charge Control Resins CCR6 and CCR7 obtained were respectively evaluated in the same way as the evaluation of physical properties of the positive charge control resin of Example 1. The results are shown in Table 1.

Production of Developing Rollers 6 and 7

Developing Rollers 6 and 7 were produced in the same manner as in Example 1 except that Positive Charge Control Resins CCR6 and CCR7 were used, respectively, in place of CCR1.

Charge Quantity of Inclined Plate Method

Measurement of Surface Layer

Evaluated in the same way as in Example 1. The results are shown in Table 2.

Evaluation of Developing Rollers 6 and 7

Evaluated in the same way as in Example 1. The results are shown in Table 3.

Comparative Example 3

Production of Developing Roller 8

Developing Roller 8 was produced in the same manner as in Example 1 except that Positive Charge Control Resin CCR1 was not used.

Charge Quantity of Inclined Plate Method

Measurement of Surface Layer

Evaluated in the same way as in Example 1. The results are shown in Table 2.

Evaluation of Developing Roller 8

Evaluated in the same way as in Example 1. The results are shown in Table 3.

1) Charge Quantity (Q/M):

The toner held on the developing roller was collected by suction through a metallic cylindrical pipe and a cylindrical filter. Charge quantity Q of electric charges accumulated on a capacitor connected to this metallic cylindrical pipe was read on a coulomb meter, and mass M of the toner collected was measured. From the charge quantity Q and mass M thus measured, the charge quantity per unit mass, Q/M (μC/g), was calculated to find the charge quantity (Q/M).

2) Fogging:

The reflectance of solid white images and the reflectance of a virgin transfer sheet were measured. The value found when the minimum value of the reflectance of solid white images was subtracted from the maximum value of the reflectance of the virgin transfer sheet was regarded as fog density. The reflectance was measured with TC-6DS (trade name; manufactured by Tokyo Denshoku Co., Ltd.).

Evaluation of Fogging:

A: Very good (less than 1.0%).

B: Good (1.0% or more to less than 2.0%).

C: Poor (2.0% or more).

3) Image Density:

Solid black images were reproduced, and their image density was measured with Macbeth Densitometer RD-918 (trade name; available from Sakata Inx Corporation).

Evaluation of Image Density:

A: Very good (1.4 or more).

B: Good (1.2% or more to less than 1.4).

C: Poor (less than 1.2).

4) Toner Scattering:

Images formed were visually evaluated to make evaluation on whether or not the toner was seen to have scattered (spots around line images).

A: No toner is seen to have scattered.

C: Toner is seen to have scattered.

5) Mottle:

Images formed were visually evaluated to make evaluation on whether or not any mottles were seen.

Evaluation on Mottle:

A: No mottles are seen.

C: Mottles are seen.

TABLE 1

| | Positive charge control resin | Acrylate or methacrylate monomer Symbol | Acrylate or methacrylate monomer Amt. (g) | Amino-group = containing monomer Symbol | Amino-group = containing monomer Amt. (g) | Carboxyl-group = containing monomer Symbol | Carboxyl-group = containing monomer Amt. (g) | Amino value (mgKOH/g) | Acid value (mgKOH/g) | Mw | Tg (° C.) |
|---|---|---|---|---|---|---|---|---|---|---|---|
| Example: | | | | | | | | | | | |
| 1 | CCR1 | A1 | 20 | B1 | 25 | C1 | 5 | 176.7 | 36.0 | 15,700 | 7.5 |
| 2 | CCR2 | A1 | 10 | B1 | 30 | C1 | 10 | 216.3 | 70.7 | 89,200 | 9.1 |
| 3 | CCR3 | A3 | 15 | B1 | 30 | C1 | 5 | 205.6 | 37.1 | 6,300 | 10.3 |
| 4 | CCR4 | A2 | 5 | B1 | 35 | C1 | 10 | 257.3 | 69.2 | 13,800 | 18.2 |
| 5 | CCR5 | A1 | 10 | B2 | 35 | C2 | 5 | 256.4 | 35.2 | 12,400 | 1.2 |
| Comparative Example: | | | | | | | | | | | |
| 1 | CCR6 | A1 | 15 | B1 | 35 | — | — | 241.4 | 0.0 | 19,100 | 11.7 |
| 2 | CCR7 | A1 | 25 | — | — | C1 | 25 | 0.0 | 177.8 | 13,500 | 1.1 |
| 3 | — | — | — | — | — | — | — | — | — | — | — |

TABLE 2

| | Developing roller No. | CCR No. | Charge quantity of inclined plate method of surface layer in N/N environment (μC/g) |
|---|---|---|---|
| Example: | | | |
| 1 | 1 | 1 | 12.6 |
| 2 | 2 | 2 | 12.5 |
| 3 | 3 | 3 | 11.5 |
| 4 | 4 | 4 | 7.4 |
| 5 | 5 | 5 | 11.5 |

TABLE 2-continued

| | Developing roller No. | CCR No. | Charge quantity of inclined plate method of surface layer in N/N environment (μC/g) |
|---|---|---|---|
| Comparative Example: | | | |
| 1 | 6 | 6 | 10.9 |
| 2 | 7 | 7 | 0.9 |
| 3 | 8 | — | 0.8 |

TABLE 3

| | Developing roller No. | CCR No. | In H/H environment: Charge quantity Q/M (μC/g) | In H/H environment: Fogging | In H/H environment: Image density | In L/L envirnmnt: Toner scattering | In L/L envirnmnt: Mottle |
|---|---|---|---|---|---|---|---|
| Example: | | | | | | | |
| 1 | 1 | 1 | −69 | A | A | A | A |
| 2 | 2 | 2 | −64 | A | A | A | A |
| 3 | 3 | 3 | −61 | A | A | A | A |
| 4 | 4 | 4 | −65 | A | A | A | A |
| 5 | 5 | 5 | −67 | A | A | A | A |
| Comparative Example: | | | | | | | |
| 1 | 6 | 6 | −68 | A | A | C | C |
| 2 | 7 | 7 | −33 | C | B | A | A |
| 3 | 8 | — | −40 | C | B | A | A |

In Examples 1 to 5, the toners had higher charge quantity by making the developing roller surface layers have higher charge quantity, to bring a good image density, less fog and also neither toner scattering nor mottles.

On the other hand, Comparative Example 1, though it showed good results in respect of the charge quantity and the fogging, had problems on the toner scattering and mottles in the image evaluation in the L/L evaluation. Also, Comparative Example 2 showed a low charge quantity of the toner and also brought about serious fogging. This is presumed to be due to the fact that the developing roller was not able to be made chargeable in a polarity reverse to the polarity of the toner, because Positive Charge Control Resin CCR7 contained the carboxyl-group-containing monomer unit but did not contain the amino-group-containing monomer unit. Still also, Comparative Example 3 showed a low charge quantity of the toner and also brought about serious fogging. This is presumed to be due to the fact that no positive charge control resin was contained.

This application claims priority from Japanese Patent Application No. 2005-174683 filed Jun. 15, 2005 and Japanese Patent Application No. 2005-185453 filed Jun. 24, 2005 which are hereby incorporated by reference herein.

The invention claimed is:

1. A positive charge control resin comprising a copolymer obtained by polymerizing as copolymerization components an acrylate or methacrylate monomer represented by Formula (1), an amino-group-containing monomer(s) represented by Formula (2) and/or Formula (3), and a carboxyl-group-containing monomer(s) represented by Formula (4) and/or Formula (5):

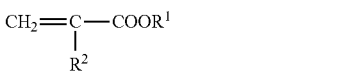

(1)

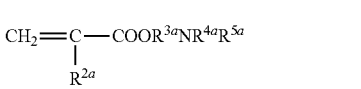

(2)

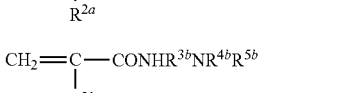

(3)

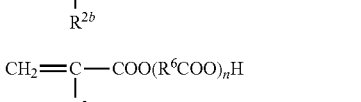

(4)

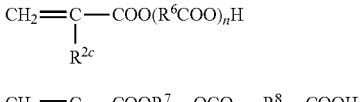

(5)

wherein $R^1$ represents an alkyl group having 4 or more carbon atoms or a fluoroalkyl group having 1 to 14 carbon atoms which has 3 or more fluorine atoms; $R^2$, $R^{2a}$, $R^{2b}$, $R^{2c}$ and $R^{2d}$ each independently represent a hydrogen atom or a methyl group; $R^{3a}$ and $R^{3b}$ each independently represent a divalent organic group having 1 to 7 carbon atoms; $R^{4a}$, $R^{4b}$, $R^{5a}$ and $R^{5b}$ each independently represent a hydrogen atom, an organic group having 1 to 20 carbon atoms, or a divalent organic group having 4 to 20 carbon atoms in which $R^{4a}$ and $R^{5a}$, or $R^{4b}$ and $R^{5b}$, have chemically combined, or a divalent organic group having 4 to 19 carbon atoms which contains at least one of an oxygen atom, a nitrogen atom and a sulfur atom and in which $R^{4a}$ and $R^{5a}$, or $R^{4b}$ and $R^{5b}$, have chemically combined; $R^6$ represents an alkylene group having 2 to 6 carbon atoms; $R^7$ represents an alkylene group having 2 to 4 carbon atoms; $R^8$ represents an ethylene group, a vinylene group, a 1,2-cyclohexylene group or a 1,2-phenylene group; and n represents an integer of 0 to 10.

2. The positive charge control resin according to claim 1, wherein said copolymer has an amino value of 5 mgKOH/g or more and 350 mgKOH/g or less, and an acid value of 0.1 mgKOH/g or more and 150 mgKOH/g or less.

3. The positive charge control resin according to claim 1, wherein said copolymer has a weight-average molecular weight Mw of 2,000 or more and 500,000 or less.

4. The positive charge control resin according to claim 1, wherein said copolymer has a glass transition temperature Tg of −100° C. or higher and 180° C. or lower.

5. A developing roller comprising a conductive shaft and provided on the outer periphery of the conductive shaft an elastic layer and at least one covering layer in this order;

said developing roller carrying on the surface thereof a negatively chargeable developer formed in a thin layer and bringing the thin-layer negatively chargeable developer into contact with or proximity to an electrostatic image bearing member to develop an electrostatic latent image formed on the electrostatic image bearing member; wherein;

said covering layer contains the positive charge control resin according to claim 1.

6. An electrophotographic apparatus comprising an electrostatic image bearing member, a charging assembly for charging the surface of the electrostatic image bearing member electrostatically, an electrostatic latent image forming assembly for forming an electrostatic latent image in the charged area of the electrostatic image bearing member, a developing assembly for feeding a negatively chargeable developer to the electrostatic latent image formed on the surface of the electrostatic image bearing member to render the electrostatic latent image visible to form a developer image, and a transfer assembly for transferring the developer image to a transfer material, wherein;

a developing roller said developing assembly has is the developing roller according to claim 5.

* * * * *